United States Patent [19]

McManigal et al.

[11] Patent Number: 5,062,669

[45] Date of Patent: Nov. 5, 1991

[54] SECURED LOCKING DEVICE

[76] Inventors: Donald P. McManigal, 12931 S. Meade, Palos Heights, Ill. 60463; David G. Yaksic, 14922 West Ave., Orland Park, Ill. 60462; John McHugh, 5437 S. Menard, Chicago, Ill. 60638

[21] Appl. No.: 554,941

[22] Filed: Jul. 16, 1990

Related U.S. Application Data

[63] Continuation of Ser. No. 331,089, Mar. 27, 1989, abandoned, which is a continuation-in-part of Ser. No. 946,783, Dec. 29, 1986, abandoned.

[51] Int. Cl.[5] ..... E05C 5/02

[52] U.S. Cl. ..... 292/60; 292/62; 292/11; 292/DIG. 25; 292/DIG. 32

[58] Field of Search ..... 292/5, 11, 13, 16, 60, 292/62, 87, 201, 202, DIG. 25, DIG. 32; 109/68; 312/218, 245; 49/141; 70/DIG. 56, DIG. 58

[56] References Cited

U.S. PATENT DOCUMENTS

| | | | |
|---|---|---|---|
| 924,803 | 6/1909 | Long | 70/DIG. 48 X |
| 1,128,365 | 2/1915 | Rothholz | 70/DIG. 56 X |
| 1,249,168 | 12/1917 | Milner | 70/DIG. 48 X |
| 1,356,774 | 10/1920 | Lanchester | 292/62 |
| 1,768,224 | 6/1930 | Welsch | 70/DIG. 48 X |
| 1,796,502 | 3/1931 | Boucher | 312/245 X |
| 2,815,085 | 12/1957 | Whipple | 292/201 X |
| 3,601,453 | 8/1971 | Silverman | 292/DIG. 32 X |
| 3,614,147 | 10/1971 | Spector | 292/DIG. 32 X |
| 3,621,684 | 11/1971 | Horvay et al. | 292/87 X |
| 3,813,119 | 5/1974 | Panici | 292/11 X |
| 4,021,066 | 5/1977 | McShane | 292/DIG. 32 X |
| 4,111,472 | 9/1978 | Smith et al. | 49/141 X |
| 4,249,345 | 2/1981 | Littleton | 49/141 X |
| 4,501,378 | 2/1985 | Berfield | 292/87 X |

FOREIGN PATENT DOCUMENTS

| | | | |
|---|---|---|---|
| 2916167 | 11/1979 | Fed. Rep. of Germany | 292/11 |
| 2304 | of 1897 | United Kingdom | 292/62 |
| 10331 | of 1914 | United Kingdom | 292/201 |

*Primary Examiner*—Gary L. Smith
*Assistant Examiner*—Michael J. Milano
*Attorney, Agent, or Firm*—Jenner & Block

[57] ABSTRACT

A lock mechanism for safely locking doors, such as trailer-tractor vehicle doors and for controllably releasing same including a reciprocal or rotatable locking member such as a sliding bolt movable up through the floor of a trailer to a first locking position wherein a door is positively locked and a release position wherein the vehicle door is released with the locking member housed in a tamper-proof box with a pivotal panel that is held shut by a latch released by a latch operator means which is activated by an air drive that can be primarily operated only when connected to the air pressure system of a vehicle.

15 Claims, 3 Drawing Sheets

33
41
37
39
39
40
38
30
29
23
31a
31b
21
21a
31
11a
VI
26
28a
16a
VI
28
17a
18a
15a
19a
19e
19c
19d
19b
29
23
21
21
43
16a
26
11d
28a

SECURED LOCKING DEVICE

This application is a continuation of application Ser. No. 07/331,089, filed Mar. 29, 1986, both abandoned.

BACKGROUND OF THE INVENTION

The present invention relates to improvements in locks, and more particularly to an improved lock mechanism for safely locking doors such as trailer-tractor vehicle doors in a secure manner so that primarily they can be opened only by connection with the air system of the vehicle.

Trailer-tractor doors are commonly latched in a closed position by manually operated latches accessible from the rear of the trailer-tractor where the doors are either swung open or raised. For security to prevent unauthorized opening, the release handles are padlocked or locked in a manner to require opening with a key or combination. However, in the absence of the driver, the padlock or other locking device can be broken, the doors opened and the contents tampered with or stolen. Security of the doors is very important inasmuch as the contents can frequently be valuable or can be of a nature such that positive prohibition from stealing is of the essence, such as when the trailer-tractor may contain equipment which must have commercial or military security or secrecy.

As an example of the lack of security provided by conventional padlocking, insurance companies and trucking companies have found that a padlocked trailer-tractor door lock can be broken and the contents of a trailer-tractor or truck stolen or partly stolen within the very short time when the truck stops at a traffic light. While the features of the invention as will be described herein are particularly well suited for use with trucks or trailer-tractor type vehicles, it will be appreciated by those versed in the art that the features may be employed for securely locking other vehicle doors such as doors on railroad cars.

In addition to externally padlocked door latches, attempts have been made to provide for internal door locks, but the operator for such locks must still be provided with a locking means such as a padlock. A feature of the present invention is the provision of a lock which is air operated so that it can be used by vehicles with an air braking system and principally operated only with high pressure air.

An object of the present invention is to provide a security locking device designed primarily to be utilized in locking trailer doors on tractor-trailer vehicles which can be used by vehicles with an air braking system.

A further object of the invention is to provide a particularly safe and secure lock mechanism for doors wherein the locking mechanism is housed in a tamper-proof box wherein access to the locking system and to the box is afforded by the application of air pressure. A further object of the invention is to provide a locking system which cannot be tampered with and which is particularly useful in a truck or tractor-trailer system inasmuch as access is under positive control of the driver.

Other objects, advantages and features will become more apparent with the teaching of the principles of the invention in connection with the disclosure of the preferred embodiments in which:

DESCRIPTION OF THE PREFERRED EMBODIMENTS

Figure 1:
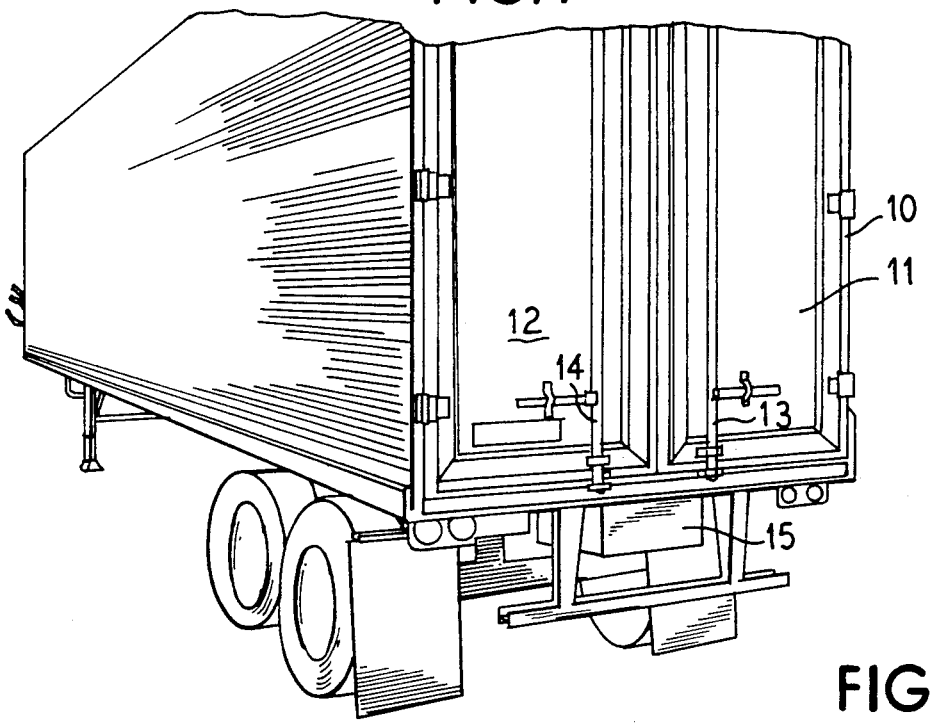
FIG. 1 is a fragmentary perspective view of the back of a tractor-trailer showing a locking system installed constructed and operating in accordance with the principles of the present invention.

FIG. 1 illustrates the rear of a tractor-trailer vehicle 10 which is provided with doors 11 and 12 hinged at their sides to swing about vertical hinges at their outer edges. Reciprocating vertical rods 13 and 14 are moved downwardly into holders on the frame to hold the doors closed and it will be recognized by those versed in the art that various arrangements are used for doors and for latching the doors. As above mentioned, these conventional arrangements are normally provided with a padlock to prevent operation, but with the breakage of the padlock, easy access to the interior of the vehicle is obtained Other forms of doors are employed, such as vertical reciprocating sectional doors which are also provided with suitable latches at the base which the operator releases to raise the door and provide access to the interior of the vehicle.

As illustrated in FIG. 1, the unique latching mechanism in accordance with the principles of the invention includes the provision of a tamper-proof steel box 15 mounted to I-beam support members below the frame of the vehicle just below the doors. This tamper-proof box is substantially unopenable except by the driver applying pressurized air of the air brake system of the vehicle.

Figure 3:
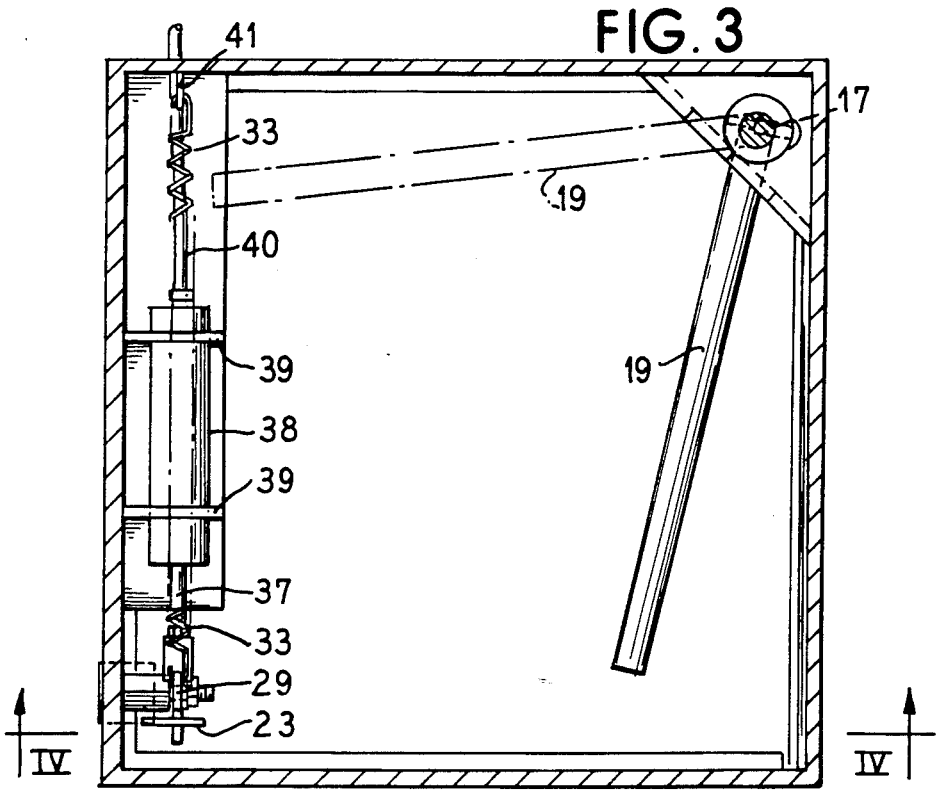
FIG. 3 is a horizontal sectional view taken substantially along line III—III of FIG. 2.
Figure 4:
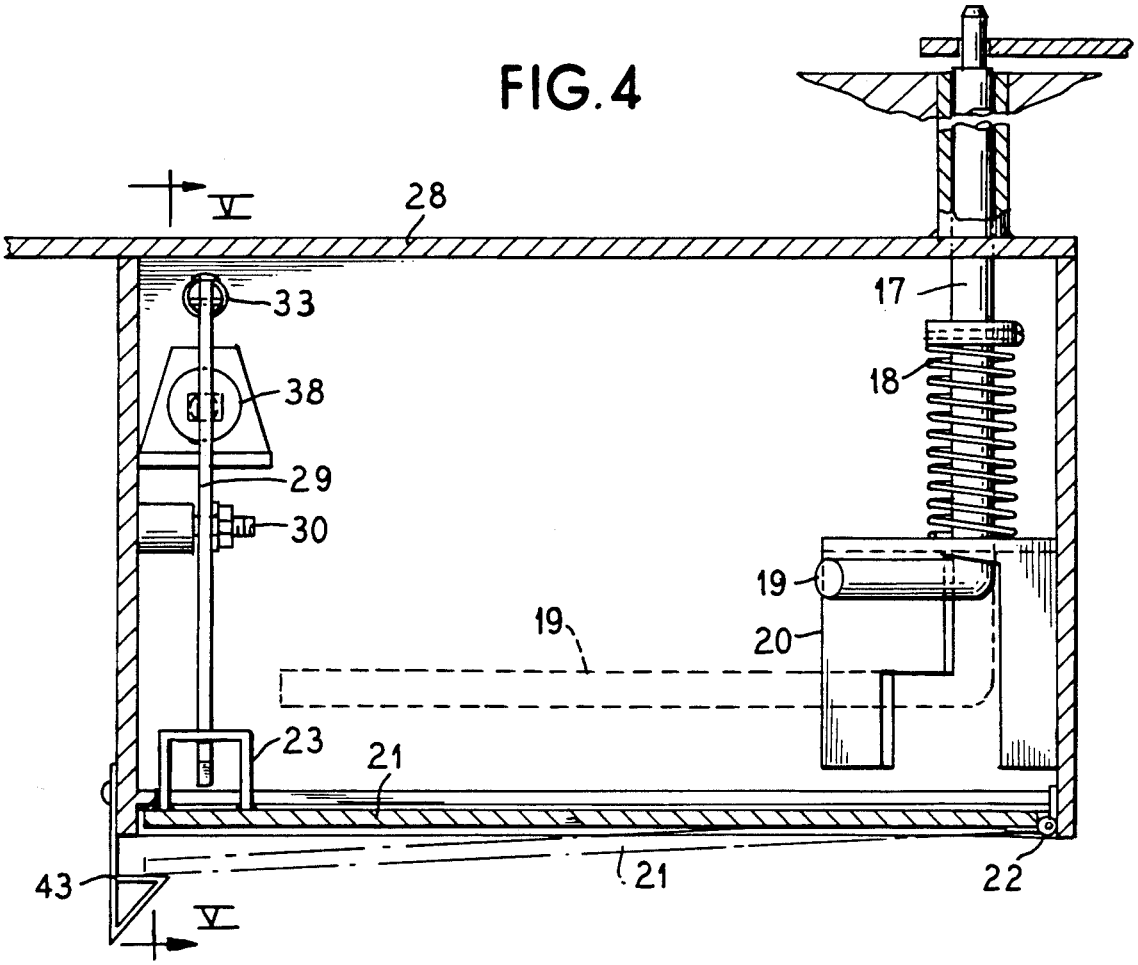
FIG. 4 is a vertical sectional view taken substantially along line IV—IV of FIG. 3.
Figures 5, 6, 7:
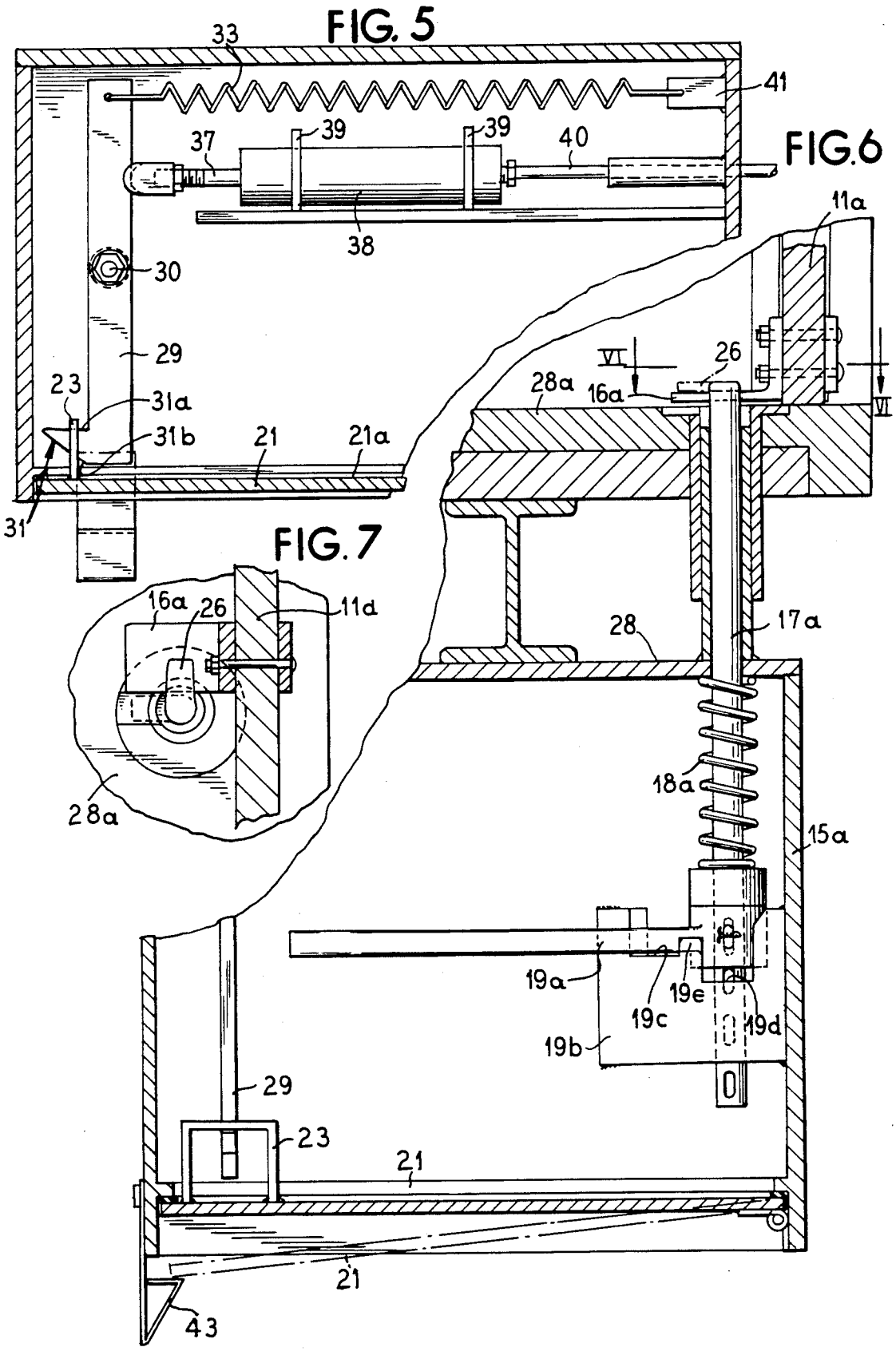
FIG. 5 is a fragmentary vertical sectional view taken substantially along line V—V of FIG. 4.
FIG. 6 is a fragmentary vertical sectional view similar to FIG. 4 but illustrating another form of the locking arrangement.
FIG. 7 is a fragmentary sectional view taken along line VI—VI of FIG. 6 illustrating the detail of a portion of the locking member.

The tamper-proof box 15 houses the latching apparatus which includes a locking member that actually functions to lock the door closed, a latch which holds a panel or door providing access to the tamper-proof box, a latch operator and an air pressure activated drive which releases the panel to provide access to the box for manual operation and release of the locking member. FIGS. 2 through 5 provide details of the locking member, and FIGS. 6 and 7 provide details of an alternative form of locking member of the type which is used by a sectional vertically openable door. As shown in FIGS. 2 through 5, only the door 11 is illustrated, but it is understood that when both doors are closed, the left door 12 cannot be opened until the right door 11 is first unlatched and opened so that only one locking mechanism need be provided for the right door 11, in order that both doors be secured.

A locking member is shown in the form of a vertical reciprocal bolt or pin 17 which has a locking top end that enters an opening in a plate 16 secured to the inner surface of the door 11. The plate 16 fits close to the floor 28 of the vehicle so as to provide a minimum obstruction. The locking bolt 17 is arranged so that it moves upwardly into an opening in the plate 16 for locking the door 11. The bolt is shown in locked position in FIG. 2 where it projects slightly above the floor. The handle is in the unlocked position in the dotted line position in FIG. 3.

Figure 2:
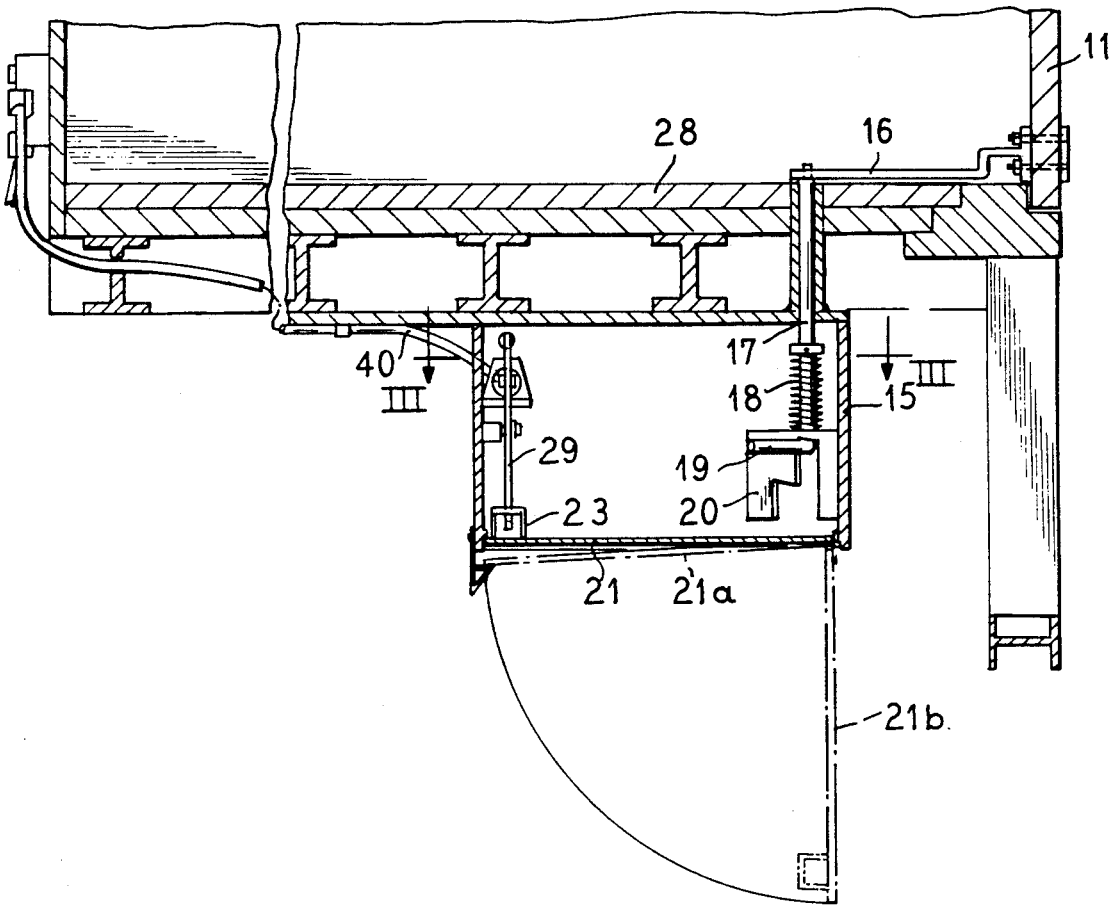
FIG. 2 is a vertical sectional view taken through the box of the locking system.

The bolt 7 is urged upwardly by a spring 18 and the coil compression spring 18 holds the bolt in locked position with a bolt handle 19 positioned as shown in FIG. 2. When the door 11 is to be unlocked, the handle 19 is manually pulled downwardly and positioned under a shoulder in a holding plate 20 which is within the box 15. The holding plate 20 allows the handle 19 to be in a deep slot as shown in FIG. 4 to allow the spring to urge the bolt to locking position, or the handle 19 may be pulled downwardly positioned under the shoulder as shown by the dotted line position of FIG. 4 to pull the bolt 17 downwardly with the tip pulled down below the level of the vehicle floor so that it does not interfere with loading and unloading.

FIGS. 6 and 7 illustrate a different form of locking mechanism, and in these figures, parts similar to the parts of FIGS. 2 through 5 are similarly enumerated with the suffix "a".

The door 11*a* is shown in closed position in FIG. 7 and is raised above the floor 28*a* to open the vehicle, this being the type of door which elevates to open the back of the trailer. A plate 16*a* is bolted to the back of the door and is positioned to allow the top end of a vertically reciprocal rod 17*a* to move beside it. The rod has a locking finger 26 at its upper end which overlies the plate 16*a* when the rod is rotated to a locked position as shown in FIG. 7. When the rod is rotated counterclockwise so that the finger 26 moves to the dotted line position of FIG. 7, the door 11 can be raised. The rod 17*a* additionally reciprocates downwardly so that the floor surface 28*a* is cleared. The rod 17*a* is continually urged in a downward direction by a coil compression spring 18*a*. The rod 17*a* has an operating arm 19*a* which is shown in the door locked position in FIG. 6.

The operating arm 19*a* is held in the locked position by being seated in a notch 19*c* in a bracket 19*b* within the box. To release the door, the operating arm 19*a* is lifted up over a projection 19*e* to drop in a deeper notch 19*d*. Moving the arm to that position will rotate the locking finger 26 to the dotted line position of FIG. 7 and also permit the spring 18*a* to push the rod 17*a* downwardly so that the operating finger drops into a recess in the floor 28*a* of the truck bed.

Before the trucker/operator can reach the locking members either 17 of FIGS. 2 through 5 or 17*a* of FIGS. 6 and 7, access must be obtained to the tamper-proof box 15 and this is obtained by a release of a panel 21 which is normally held in the closed solid line position of FIGS. 2 through 5 and 7.

The panel 21 is preferably at the base of the box for ease of accessibility and operation of the rods 17 and 17*a*, for better protection against rain and snow, and for better security against access from unauthorized personnel. The panel 21 is hinged along one side at 22 to drop downwardly toward open position. While the hinge 22 is shown at the rear side of the box, it will be understood that the hinge location is optional and, for example, the hinge could be on the left or righthand side of the box so that the panel 21 would swing to the left or right when released. When the panel 21 is released about the edge opposite the hinge 22, it drops downwardly to a first dotted line position 21 and then can be manually released by the trucker/operator to drop fully down by gravity to the fully open position at 21*b*, FIG. 2.

The panel 21 has a bracket 23 thereon with an overhanging portion that is engaged by a hook 31, FIG. 5, to hold the panel in closed position. The hook 31 forms part of a latch means which includes a rocker arm 29 pivotally supported within the box at 30. A coil tension spring 33 urges the latch to a normal locked position wherein the panel 21 is locked closed.

The latch is designed for a particularly strong holding capability with an upper surface 31*a* of the latch formed at a slightly inclined angle so that as the latch 31 moves in the arcuate path on its arm 29, the incline of the surface 31*a* will approximate the slope of the arc insuring that the panel 21 is held firmly tight. The panel has a rubber gasket 21*a* around its edge for sealing the interior of the box against dust and moisture, and because of the angle of the latch surface 31*a*, it will tend to draw the panel upwardly by a camming action to compress the rubber gasket 21*a*. Actually, the angle of the surface 31*a* is chosen so that a camming action will occur and the panel 21 will be drawn forcibly upwardly to compress the seal 21 when the rocker arm swings to closed position as it is urged by the force of the spring 33.

The lower surface of the latch hook 31 is angled sharply upwardly as shown at 31*b* so that when the panel 21 is slammed shut, the bracket 23 will force the hook 31 to the right so that the bracket slides over the tip of the hook and the hook 31 can snap into locked position in the opening under the bracket 23.

Means are provided for pivoting the rocker arm 29 to release position to accommodate free opening of the panel 21. The means for moving the latch to a release position includes a latch operator means. The latch operator means for releasing the hook 31 includes a cylinder and piston 38 mounted on brackets 39 within the box. Within the cylinder is a piston connected to a piston rod 37 and when air pressure is supplied to the cylinder 38 from an air pressure hose 40, the piston rod 37 moves in a downward direction, as shown in FIG. 3, to rock the arm 29 and release the panel 21. A tension spring 33 connected between the rocker arm 29 and a bracket 41 within the box pulls the rocker arm 29 to hold it in latched position. The force of the spring 33, of course, is overcome when the cylinder 38 is pressurized and the piston rod 37 abutting the upper end of the rocker arm 29 positively moves the rocker arm to release the latch and allow the panel to drop downwardly. Air in an air pressure hose 40 is supplied from the vehicle when the vehicle operator connects the line to the pressurized air brake system of the tractor. The hose 40 is firmly attached to the trailer and preferably is supported and protected by being led through openings drilled through the web of the I-beam which provide protective support and do not weaken the beam any appreciable amount.

In operation, the tamper-proof box 15 is normally kept closed and cannot be opened except by connection by the driver of the air brake system to the air hose 40. When the driver of the vehicle stops and wishes to have access to the interior by opening the doors, he connects the air system so that air pressure moves the piston rod 37 downwardly as shown in FIG. 3. The piston rod 37 acts against the tension of the spring 33 to pivot the rocker arm 29 in a counter-clockwise direction as shown in FIG. 5. This moves the hook 31 out from under the overhanging portion of the bracket 23 to permit the panel 21 to drop. A secondary manual catch 43 may be provided to catch the panel 21 as it drops downwardly. The operator then can push the spring catch 43 back to permit the panel 21 to drop down to the fully opened position 21*b* as shown in FIG. 2. The operator then has full access to the tamper-proof box 15 and reaches upwardly to grasp the arm 19 pulling the rod 17 downwardly so that the door 11 is released and can be opened. In the arrangement of FIGS. 6 and 7, the arm 19*a* is swung horizontally so that the finger 26 passes off the edge of the plate 16*a* and releases the door 11*a* to be raised.

Thus, it will be seen that we have provided an improved lock mechanism which meets the objectives and advantages above set forth and provides a secure tamper-proof arrangement which is reliable and relatively inexpensive in construction. This can be used on new construction or installed on existing tractor trailers.

We claim as our invention:

1. A lock mechanism for licking the rear doors of a trailer-tractor having support members secured to the floor of the trailer comprising:

a tamper-proof enclosure secured to the support members below the floor and generally between and behind at least one rear wheel of the trailer for preventing unauthorized access to said lock mechanism from outside the trailer, said enclosure including a rotatably secured panel member;

a manually operable locking mechanism for locking at least one trailer rear door including an actuating rod extending through the floor to the interior of the trailer and operatively connected to a door locking arrangement in an interior portion of the trailer and a handle located with said tamper-proof enclosure secured to said actuating rod;

means for receiving air pressure; and a latch mechanism operatively connected to said air pressure receiving means and contained within said tamper-proof enclosure effective to selectively permit said panel to rotate downwardly in response to gravity to provide access to said handle.

2. The lock mechanism of claim 1 wherein said rotatably secured panel member rotates about a substantially horizontal axis.

3. The lock mechanism of claim 1 wherein said actuating rod is reciprocally movable through said floor of said trailer for locking or unlocking at least one of said rear doors.

4. The lock mechanism of claim 3 wherein said actuating rod is recessed below said floor when said doors are in an unlocked condition.

5. The lock mechanism of claim 1 wherein said actuating rod includes a locking finger for holding at least one door positively locked.

6. The lock mechanism of claim 5 wherein said actuating rod is reciprocally movable through said floor of said trailer.

7. The lock mechanism of claim 1 wherein said latch mechanism includes a pivotable rocker arm movable between a latched position and an unlatched position.

8. The lock mechanism of claim 1 wherein said latch mechanism includes spring means for urging said latch mechanism towards said latched position.

9. The lock mechanism of claim 1 wherein said latch mechanism includes a hook having a curved upper cam surface for forcibly drawing the rotatably secured panel member to a closed position with a mechanical advantage.

10. The lock mechanism of claim 1 wherein said air pressure receiving means includes a piston and a cylinder.

11. The lock mechanism of claim 1 wherein said air pressure receiving means is driven by air pressure from an air supply of the vehicle.

12. The lock mechanism of claim 1 wherein said manually operable locking mechanism includes a handle manually movable by an operator for moving the manually operable locking mechanism between a locked position and an unlocked position.

13. The lock mechanism of claim 1 wherein said lock mechanism includes secondary manual latching means for latching said rotatably secured panel member which is externally accessible after said panel member has been unlatched by said latching means.

14. The lock mechanism of claim 13 wherein said secondary manual latching means includes a catch member secured to said enclosure effective to engage said panel member after said latching means is unlatched.

15. The lock mechanism of claim 13 wherein said secondary manual latching means is effective to retain said panel member in a partially open position after said latching means is unlatched.

* * * * *